US006282999B1

(12) United States Patent
Hite et al.

(10) Patent No.: US 6,282,999 B1
(45) Date of Patent: Sep. 4, 2001

(54) PLUMBING PART INSTALLATION AND REMOVAL TOOL

(75) Inventors: Michael J. Hite, Lynwood; Lawrence P. Gillen, Rancho Cucamonga, both of CA (US)

(73) Assignee: Pasco Specialty & Mfg. Co., Inc., Lynwood, CA (US)

( * ) Notice: Subject to any disclaimer, the term of this patent is extended or adjusted under 35 U.S.C. 154(b) by 0 days.

(21) Appl. No.: 09/550,124

(22) Filed: Apr. 17, 2000

(51) Int. Cl.[7] ..... B25B 23/10
(52) U.S. Cl. ..... 81/445; 411/55; 411/65
(58) Field of Search ..... 81/445, 1, 442, 81/90.2, 455, 53.2; 403/370, 371, 374.4; 411/55, 65, 64, 63, 60.2, 57.1

(56) References Cited

U.S. PATENT DOCUMENTS

| | | | | |
|---|---|---|---|---|
| 1,180,758 | * | 4/1916 | Brekke et al. | 81/455 |
| 2,497,633 | * | 2/1950 | Shapiro et al. | 81/455 |
| 2,719,747 | * | 10/1955 | Layne | 294/89 |
| 3,181,396 | * | 5/1965 | Nance | 81/455 |
| 4,237,754 | | 12/1980 | Battrick | 81/439 |
| 4,589,180 | * | 5/1986 | Vachon | 29/263 |
| 4,611,485 | * | 9/1986 | Leslie | 73/49.8 |
| 4,724,608 | * | 2/1988 | Parrott | 29/724 |
| 5,669,404 | * | 9/1997 | Guillermo | 137/15 |

* cited by examiner

*Primary Examiner*—James G. Smith
*Assistant Examiner*—David B. Thomas
(74) *Attorney, Agent, or Firm*—Charles H. Thomas

(57) ABSTRACT

A plumbing tool is constructed for installing and removing plumbing parts such as tub and sink drains that are engaged together by conventional right-hand threads, one within another. The tool can also be constructed to remove or install left-hand parts. The plumbing extraction and installation tool has an elongated core member with a stud at one end, a cylindrical intermediate section threaded with right-hand threads, and an outwardly flared frustoconical section at the end opposite the stud. A barrel member is internally threaded with right-hand threads at one end and a radial channel is defined in its inwardly facing wall. This channel is bounded by a radially inwardly directed annular lip at its lower extremity. A plurality of wedge members have hooks or tangs at their upper proximal ends that are captured between the barrel member and the core member. Advancement of the barrel member into threaded engagement with the externally threaded portion of the core member causes the distal ends of the wedge members to be pushed radially outwardly to engage the inner cylindrical wall of a plumbing part to be gripped. The tool with the plumbing part frictionally engaged by the wedge elements is then rotated into either a clockwise direction to advance or install a movable plumbing part coaxially within a surrounding stationary plumbing part, or in a counterclockwise direction to remove or disengage one plumbing part relative to another.

16 Claims, 6 Drawing Sheets

PLUMBING PART INSTALLATION AND REMOVAL TOOL

BACKGROUND OF THE INVENTION

1. Field of the Invention

The present invention is a tool useful for removing and installing plumbing parts and plumbing fixtures.

2. Description of the Prior Art

Various types of different plumbing tools have long been available for use in installing and removing various plumbing fixtures, such as bathtub and sink drains. One such device has been sold by Pasco Specialty and Manufacturing, Inc., located in Lynnwood, Calif., as the SMART DUMBELL drain and closet spud installation and removal tool. This tool is about six inches long and is formed of an aluminum bar having enlargements at both ends. Fingers project longitudinally from these enlargements and fit into openings between radial spokes in a tub or sink drain. With the bar positioned upright and with the fingers of the tool projecting in between the radial spokes of the drain, the hexagonal shank of the bar is twisted with a pipe wrench to install or removed the drain. This tool is described in U.S. Pat. No. 4,237,754 and has performed quite admirably throughout the years. However, is limited for use with only certain models tub drains and closet spuds.

Another conventional plumbing drain installation and removal tool is sold by Elftmann Brothers, located in Phoenix, Ariz., as the Ultimate Bathtub Drain Extracter and Installer. This tool operates on the principle of an expandable wedge in which a plurality of leaves or shoes are forced radially outwardly over the outwardly flared end of an elongated core by advancing an internally threaded nut having internal left-hand threads defined thereon along a corresponding cylindrical portion of the core having external left-hand threads defined thereon. The shoes are held in contact with the core by a resilient rubber O-ring that encircles the shoes and seats in grooves in the outer surfaces of the shoes. Advancement of the a nut against a washer located beneath the nut causes the shoes to be forced radially outwardly so that they frictionally engage the cylindrical wall of the drain. Rotation of the core with a wrench in one direction causes the drain to become unthreaded from the drain pipe to which it is attached. Rotation of the core with a wrench in the other direction advances the drain into engagement in the drain pipe since the universal standard in the industry is for the threaded engagement of plumbing parts by means of right-hand threads.

One significant disadvantage of the Ultimate Bathtub Drain Extracter and Installer Tool is that it is relatively easy for the O-ring to break, thus allowing the shoes to become detached from the other parts of the tool. Moreover, the shoes are rather small and can easily fall down the drain when this occurs. Not only is the tool thereafter inoperable, but the drain line is quite likely to become clogged as well.

SUMMARY OF THE INVENTION

The present invention involves an improved tool that is useful not only for the installation and removal of tub and sink drains, but which is also useful for disconnecting other plumbing parts from each other and engaging them with each other. Different sizes and embodiments of the tool of the invention may be utilized to extract virtually any removable plumbing part that is engaged coaxially within an exterior cylindrical portion of a surrounding stationary plumbing part. For example, the tool of the invention can be utilized to remove a threaded pipe end broken off within an internally threaded elbow. It may also be utilized to remove or install an outer plumbing part disposed about another stationary plumbing part to which it is secured. For example, the tool of the invention can be used to remove a coupling from a plumbing drain line.

The plumbing tool of the invention has distinct advantages over conventional wedging type removal tools. Specifically, the tool of the invention employs a plurality of wedge elements which cannot accidentally become separated from the core and barrel components of the tool when the tool is in use.

In one broad aspect the present invention may be considered to be a plumbing tool comprising an elongated solid core element, a hollow, annular barrel element, and a plurality of wedge elements. The core element has a stud end, an intermediate cylindrical section bearing external right-hand threads, and an outwardly flared opposite end that increases in diameter with distance from the intermediate threaded cylindrical section. The barrel element is shorter than the core member and has an interior surface, one end of which has internal right-hand threads defined thereon. The other end of the barrel element has a radially inwardly directed lip defined thereon. The barrel element also has an annular, radially inwardly facing groove defined in its inner surface between the internal threads and the lip.

Each of the wedge elements has a proximal end with a radially outwardly projecting tang or hook formed thereon and a distal end having an arcuate, concave radially inwardly facing surface. The wedge elements are disposed about the core element in angular displacement from each other with all of their tangs engaged in the groove and captured between the barrel element and the core element by the annular lip. The wedge elements are thereby restrained from longitudinal movement relative to the barrel element, whereby the distal ends of the wedge elements are coupled to the lip for limited radial rotational movement relative thereto.

Preferably, the distal ends of the wedge elements have convex, outwardly facing arcuate surfaces, and each of the wedge elements has an arcuate cross-sectional configuration. Each of the wedge elements preferably has an arcuate groove defined at its proximal end in its outwardly facing surface to receive the lip therein.

Preferably also the radial thickness of the distal ends of the wedge elements decreases with increasing distance from their proximal ends and from the stud end of the core element. In the preferred embodiment of the invention, a total of three wedge elements are employed and the flared end of the core element has a frustoconical shape.

In another aspect, the invention may be considered to be a plumbing tool comprising a solid core member, a hollow barrel member, and a plurality of elongated wedge members. The core member is formed with a part-engaging end section, a cylindrical intermediate section with external right-hand threads defined thereon, and a stud section having a maximum cross-sectional dimension no greater than the diameter of the cylindrical section. The diameter of the part-engaging section increases from the intermediate section with distance from the stud section. The barrel member is shorter than the core member and has a core-engaging end with a radial inner surface having internal right-hand threads defined thereon.

The core-engaging section is threadably engaged with the threaded section of the core. The barrel member also has an opposite wedge-engaging end with a radial inner surface having a radially inwardly projecting annular lip at its extremity and a channel formed in the radial inner surface of the wedge-engaging end. The channel is located between the lip and the core-engaging end of the barrel member. A plurality of elongated wedge members are disposed in angular displacement from each other about the core member. Each of the wedge members has a hooked proximal end that extends radially outwardly and is captured in the channel by the lip between the core member and the barrel member.

Preferably the distal end of each wedge member has an arcuate, concave, radially inwardly facing surface and is tapered in thickness so that the thickness of the distal end of each wedge member decreases with distance from the proximal end. Preferably also, the barrel member has an exterior surface with gripping tool-engaging flats defined thereon to receive a gripping tool, such as a wrench.

The invention may be described with greater clarity and particularity by reference to the accompanying drawings.

DESCRIPTION OF THE EMBODIMENT

Figure 1:
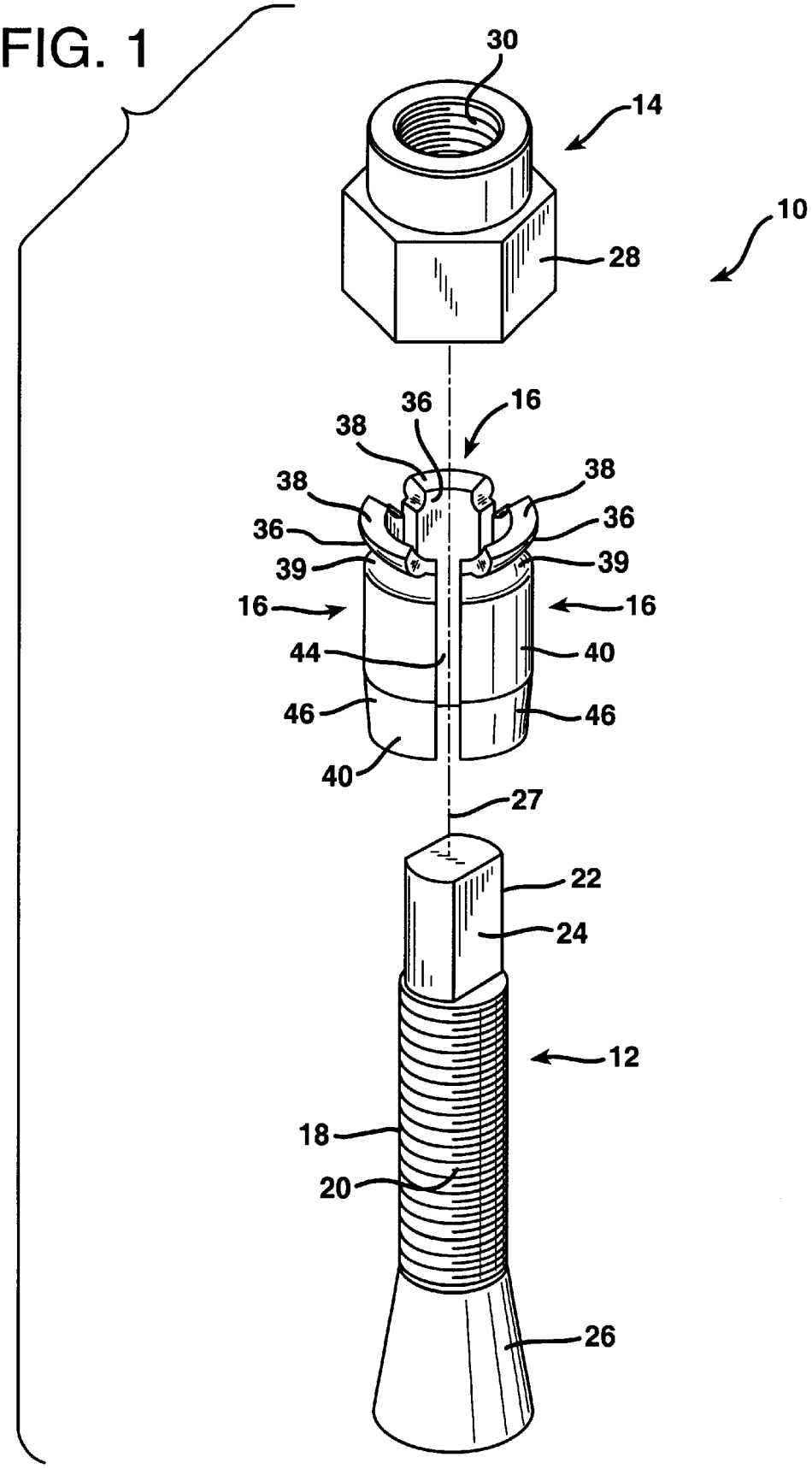
FIG. 1 is a perspective view illustrating the component parts of a preferred embodiment of a plumbing tool according to the invention.

FIG. 1 illustrates a plumbing tool 10 comprised of an elongated core member 12, an annular barrel member 14, and a plurality of elongated shoes or wedge members 16. The core member 12 and the barrel member 14 are both preferably formed of steel, while the elongated wedge members 16 are preferably formed of aluminum.

The elongated core member 12 is formed with an externally threaded intermediate cylindrical section 18 having opposing ends and having right-hand threads 20 defined thereon. At one end of the threaded cylindrical section 18 there is a longitudinally projecting stud 22 having opposing planar, mutually parallel gripping tool flats 24 defined thereon. The tool gripping stud section 22 is preferably about three-quarters of an inch in length. The gripping tool flats 24 are wide enough to accommodate the jaws of a crescent wrench, pipe wrench, monkey wrench or other gripping tool. The stud section 22 has a maximum cross-sectional dimension no greater than the diameter of the cylindrical section 18.

At the other end of the threaded cylindrical section 18, the elongated core member 12 is formed with an outwardly flared, frustoconical, part-engaging section 26 that increases in diameter with distance from the intermediate cylindrical section 18 and from the stud section 22. The outwardly flared taper of the frustoconical section 26 is preferably an angle of between about ten and fifteen degrees relative to the longitudinal axis of alignment 27 of the components of the tool 10. The maximum diameter of the frustoconical section 26 is preferably about one and one-quarter inches while the pitch diameter of the threaded cylindrical section 18 is preferably about three-quarters of an inch. The frustoconical section 26 is preferably about one inch in axial length while the cylindrical section 18 is preferably about two and one-quarter inches in axial length.

The barrel member 14 is shorter than the core member 12 and has a hexagonal external tool gripping surface 28 with six wrench gripping flats of equal dimensions defined thereon about the circumference of its exterior surface. The barrel member 14 is preferably about one and one-quarter inches in axial length. Internal right-hand threads 30 are defined on one end of the inner wall surface of the core-engaging end of the barrel member 14. The internal threads 30 have the same pitch and diameter as the external threads 20 defined on the threaded cylindrical section 18 of the core member 12.

Figure 2:
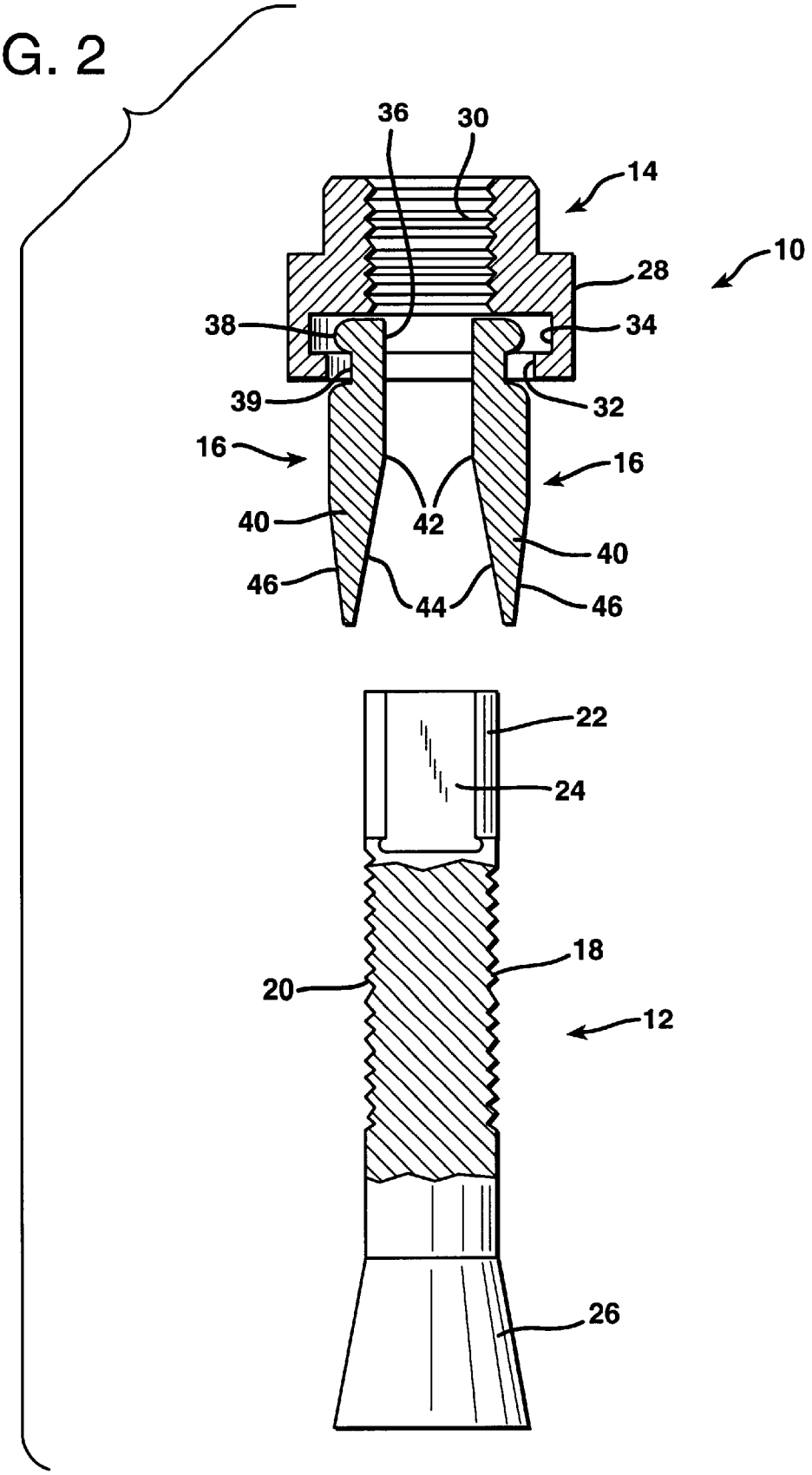
FIG. 2 is a side sectional elevational view of the tool of the invention illustrating the wedge elements engaged with the barrel element for assembly with the core element.

At its other wedge-engaging end the barrel member 14 has a radially interior wall surface that defines a radially inwardly projecting annular lip 32 at its extremity. A radial channel or groove 34 is formed in the radial inner surface of the wedge-engaging end of the barrel 14. The channel 34 is located between the lip 32 and the internal right-hand threads 30, as best illustrated in FIG. 2.

Figure 6:
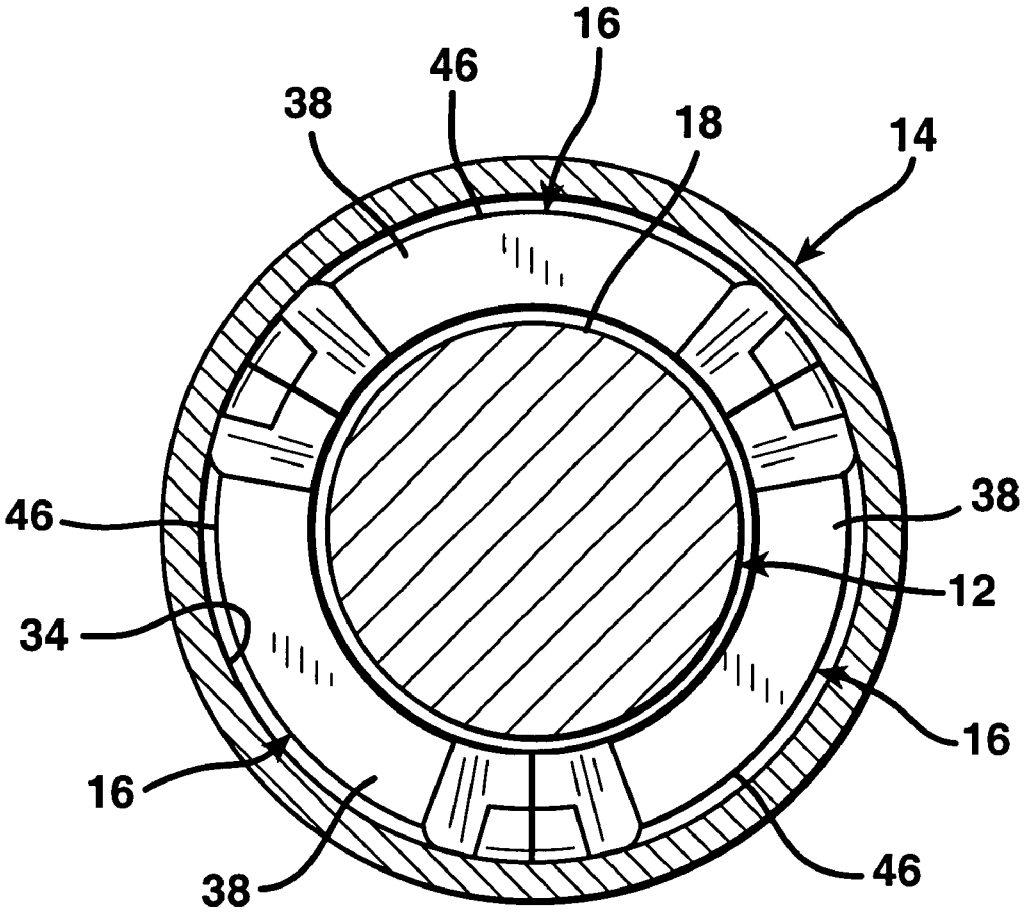
FIG. 6 is a transverse sectional view taken along the lines 6—6 in FIG. 3.

As illustrated in FIG. 6, each of the wedge members 16 has an arcuate cross section. As shown in FIG. 2, each wedge member 16 has a proximal end 36 with a radially outwardly projecting hook 38 thereon and a tapered distal end 40 that decreases in thickness with distance from the proximal end 36 from the location 42 on the distal end 40. The distal ends of the wedge members have arcuate, concave radially inwardly facing surfaces 44 and arcuate, convex outwardly facing surfaces 46. The interior wall surface of the proximal end 36 has an arcuate cylindrical shape, while the interior wall surface of the distal end 40 has a concave, frustoconical wall surface 44 facing the elongated core member 12. The outer wall surface 46 of the distal end 40 is curved convex outwardly and is cylindrical in its upper portion and slightly frustoconical in shape, tapering inwardly a few degrees at its extremity remote from the proximal end 36.

Each of the wedge members 16 is formed with a neck of reduced thickness at the proximal end 36. The neck has an outwardly facing depression 39. The lip 32 projects radially inwardly into the outwardly facing depressions 39 in the necks of all of the wedge members 16.

The three wedge members 16 are disposed about the circumference of the core member 12 in angular displacement from each other. The hooks or tangs 38 of the wedge members 16 all project into the channel 34 defined in the interior wall of the barrel member 14 so that the proximal ends 36 of all of the wedge members 16 are all captured by the annular lip 32 between the barrel member 14 and the core member 12. The proximal ends 36 of the wedge elements 16 are coupled to the lip 32, which acts as a fulcrum. The lip 32 permits limited radial rotational movement of the distal ends 40 of the wedge elements 16 relative to the barrel member 14 and the core member 12. The wedge members 16 are thereby all restrained from longitudinal movement relative to the barrel member 14 by the lip 32, while the distal ends 40 of the wedge members 16 extend longitudinally beyond the lower extremity of the barrel member 14 and alongside the frustoconical section 26 of the core member 12.

Figure 3:
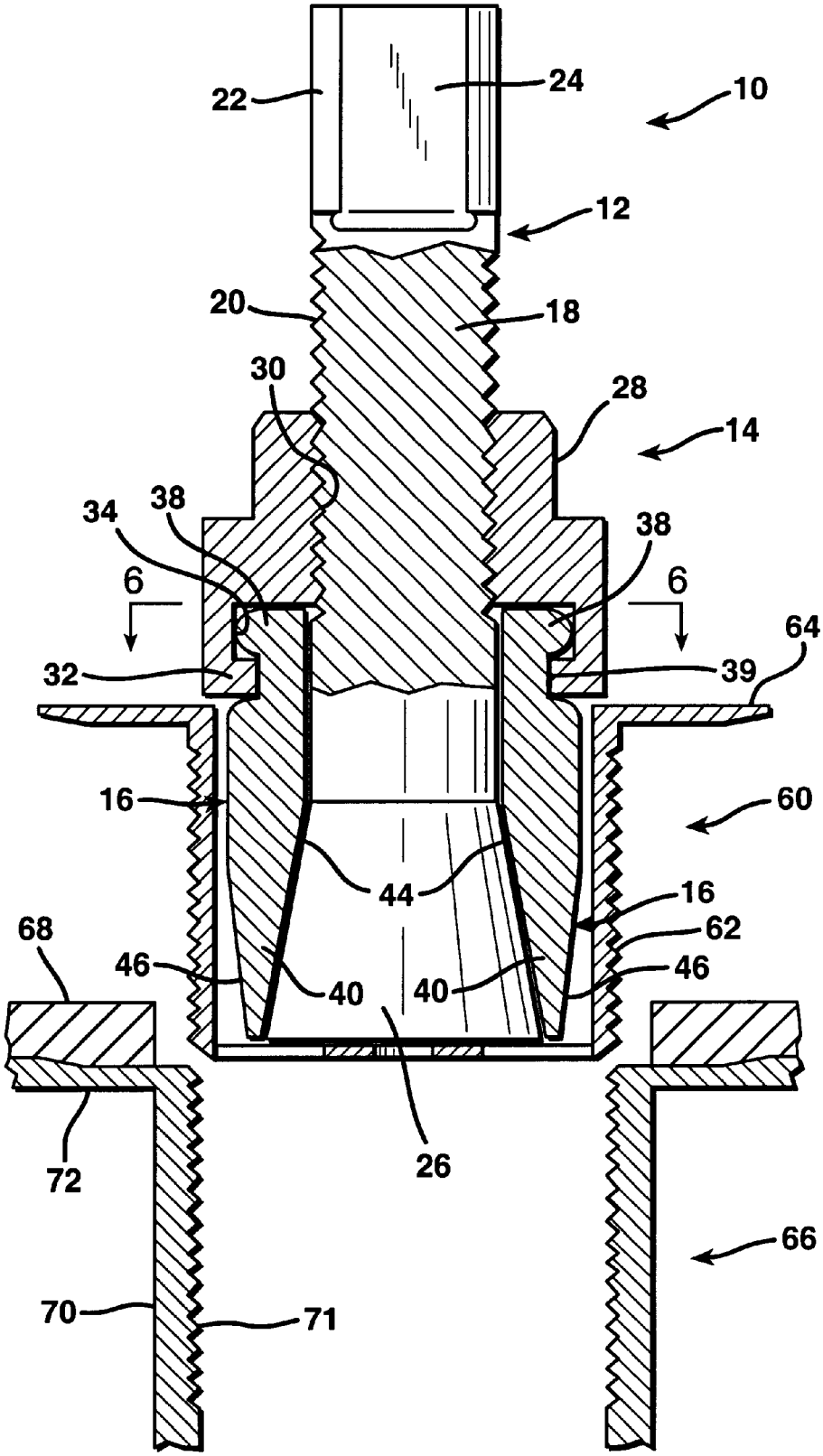
FIG. 3 is a side sectional elevational view illustrating the tool of the invention as deployed in preparation for gripping a tub drain.
Figure 4:
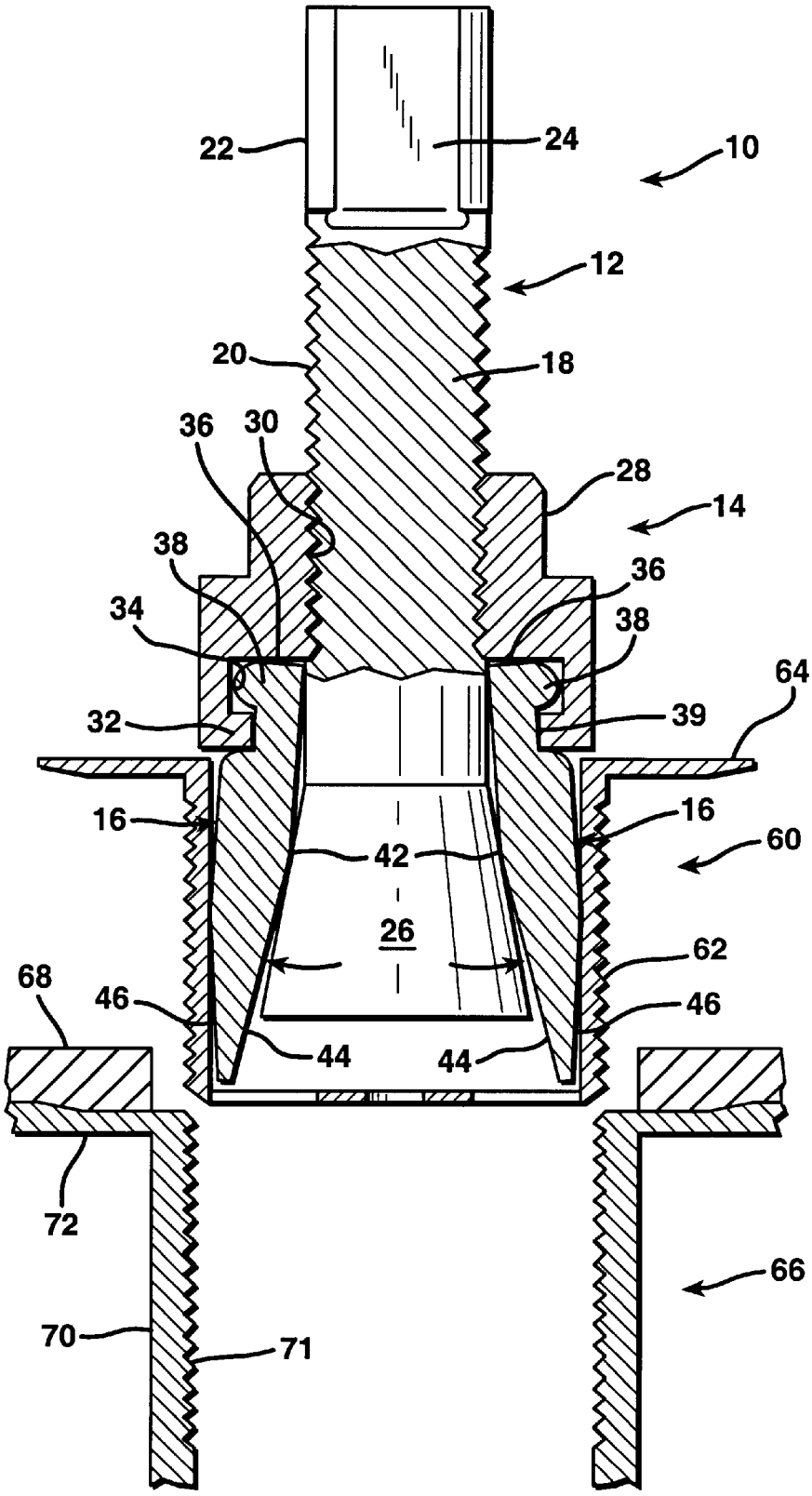
FIG. 4 is a sectional elevational view illustrating the tool of the invention in preparation for installation of a tub drain in a drain pipe.
Figure 5:
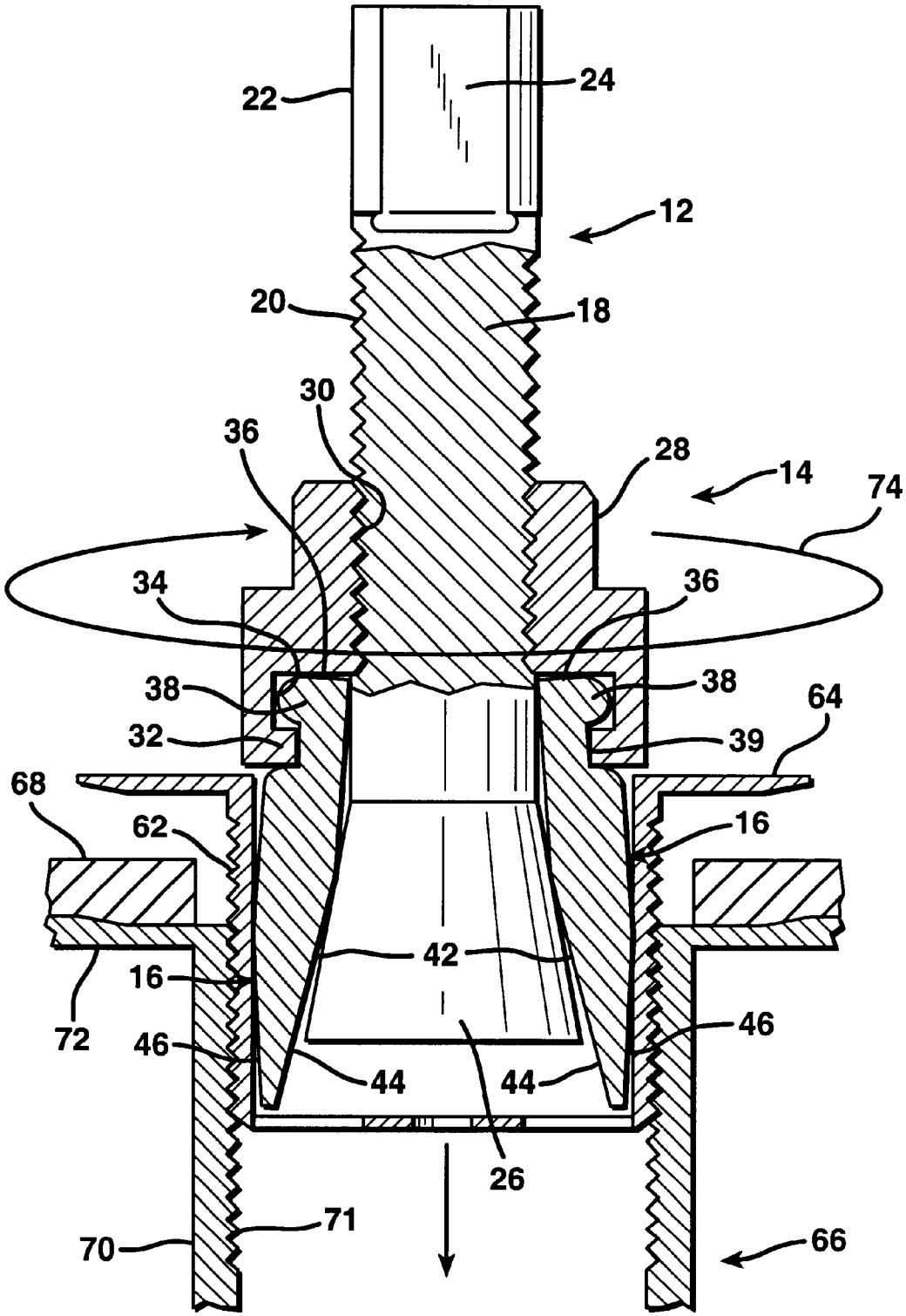
FIG. 5 is a sectional elevational view illustrating the tool of the invention during installation of a tub drain in a drain pipe.

The assembly and use of the plumbing tool 10 is illustrated in FIGS. 3, 4, and 5. To assemble the plumbing tool 10, proximal ends 36 of the wedge elements 16 are inserted separately into the wedge-engaging end of the barrel member 14 so that the hooks or tangs 38 project radially outwardly into the channel 34 and so that the lip 32 of the barrel 14 extends radially inwardly into the depressions 39 at the necks of the wedge elements 16. The barrel member 14 with the wedge elements 16 arranged in this manner, as shown in FIG. 2, is then lowered onto the stud section 22 of the core element 12 until the internal right-hand threads 30 of the barrel member 14 meet the external right-hand threads 20 on the cylindrical section 18 of the core element 12. The barrel member 14 is then rotated in a clockwise direction relative to the core member 12, as viewed from above the stud section 22, thereby threadably engaging the right-hand threads 30 of the barrel member 14 with the right-hand threads 20 of the core element 12. The barrel member 14 is then threaded onto the core member 12 further until all of the threads 30 have been engaged with the threads 20 on the cylindrical portion 18 of the core element 12, as illustrated in FIG. 3.

The plumbing tool 10 may be used for installing or extracting virtually any removable plumbing part having a hollow externally threaded, cylindrical portion engaged coaxially within an internally threaded cylindrical portion of a surrounding stationary plumbing part. The tub drain 60 is a conventional tub drain having a cylindrical body with external right-hand threads 62 defined thereon and a radially outwardly projecting flange 64 at its upper extremity. The tub drain 60 is adapted for engagement with a flanged drain pipe 66 located at the underside of the drain opening in the floor 68 of a tub or sink. The drain pipe 66 has an upper end 70 internally threaded with right-hand threads 71 and a radially outwardly projecting bearing flange 72 that is disposed in bearing relationship against the underside of the floor 68 of a bathtub or sink.

To engage the tub drain 60, the lower part-engaging end of the tool 10 is inserted into the inner cylindrical portion of the tub drain 60 as shown in FIG. 3. The barrel member 14 is the rotated further in a clockwise direction while holding the core member 12 stationary. The barrel member 14 may be rotated by means of a conventional crescent wrench, the jaws of which are engaged upon two diametrically opposed tool gripping flats on the gripping surface 28 on the barrel member 14 while holding the stud 22 stationary with another crescent wrench, the jaws of which grip the wrench gripping flats 24 of the stud section 22. Alternatively, the barrel member 14 may be held stationary and the core member 12 may be rotated in a counterclockwise direction relative thereto by means of a crescent wrench engaged with the stud 22. In either manner of manipulation, the barrel 14 will be advanced longitudinally along the central cylindrical portion 18 of the core element 12.

As the wedge elements 16 are forced by the barrel member 14 longitudinally toward the lower extremity of the flared section 26 of the core element 12, the outwardly tapered inclined surface of the flared section 26 acts against the concave inwardly facing surfaces 44 of the distal end 40 of the wedge members 16, forcing them radially outwardly. As the barrel element 40 is advanced longitudinal toward the outwardly flared section 26 of the core element 12, the convex outer surface 46 of the wedge elements 16 contacts and frictionally engages the inner, cylindrical wall surface of the sink drain 60. When the wedge elements 16 have been advanced longitudinally a sufficient distance along the frustoconical surface of the part-engaging section 26 of the core element 12, the lower portion of the tool 10 is tightly engaged within the interior cylindrical wall surface portion of the tub drain 60, as illustrated in FIG. 4.

The wrench or other tool gripping the barrel member 14 is then released from the tool gripping flats 28. Clockwise rotation of the crescent wrench or other tool engaging the stud 22 is continued, thereby advancing the tub drain 60 into threaded engagement with the drain pipe 66, as shown in FIG. 5. As the core element 12 is turned in clockwise rotation relative to the drain pipe 66, as indicated by the directional arrow 74 in FIG. 5, it carries with it in rotation the barrel member 14, the wedge elements 16, and the tub drain 60. Clockwise rotation of the stud 22 is continued until the tub drain 60 has been firmly seated in the opening in the floor 68 of the tub. Typically a seal is formed by some type of sealant on the underside of the tub drain flange 64 against the upwardly facing surface of the tub floor 68.

To remove the tub drain 60 from the drain pipe 66, there is a corresponding but opposite manipulation of the tool 10. That is, with the tub drain 60 threadably engaged with the drain pipe 66 with its flange 64 bearing against the upper surface of the floor 68 of the tub, the tool 10 is inserted into the tub drain 60. It is positioned in the tub drain 60 with the barrel member 14, the wedge elements 16 and the core member 12 in the same relative positions as shown in FIG. 3.

The core element 12 and barrel member 14 are then rotated relative to each other to advance the barrel member 14 away from the stud 22 and toward the flared section 26 of the core element 12 in the manner previously described. Once the distal ends 40 of the wedge elements 16 have been forced radially outwardly to securely frictionally grip the inner wall surface of the tub drain 60, relative rotation between the core element 17 and the barrel element 14 ceases.

At this point, however, the core element 12 is rotated in a counterclockwise direction, rather than a clockwise direction. The counterclockwise rotation of the core element 12 by means of a crescent wrench or other lever engaged with the tool gripping flats 24 of the stud 22 turns the core element 12 in counterclockwise rotation. Due to the frictional engagement between the wedge elements 16 and both the inner cylindrical surface of the drain 60 and the frustoconical surface 26 of the core element 12, all of these structures are turned in counterclockwise rotation as well. Because the threads 62 on the tub drain 60 and the drain pipe 66 are conventional, right-hand plumbing threads, counterclockwise rotation of the core member 12 threadably disengages the tub drain 60 from the drain pipe 66.

The tool 10 has a unique construction that allows it to be used to engage and disengage a wide variety of different plumbing parts coaxially coupled one within another by conventional right-hand pipe threads. Plumbing tools 10 constructed in different sizes may be utilized for different applications. The tool 10 may, for example, be constructed with threads on the barrel 14 and the core 12 in a variety of standard thread sizes, such as one-half inch, three-quarters of an inch and one inch.

The tool 10 may be utilized to insert and remove sprinkler risers, urinal spuds, mop sink drains, bar sink drains, galvanized nipples screwed into a plumbing T, the "dirty arm" of a drain underneath a kitchen sink and other plumbing parts coaxially engaged with conventional right-hand threads. The tool of the invention has a distinct advantage over the use of pipe wrenches because pipe wrenches tend to deform the coaxially engaged parts into an oval shape, especially if those parts are brass.

Undoubtedly, numerous variations and modifications of the invention will become readily apparent to those familiar with plumbing tools and plumbing parts. For example, knurling on an outer cylindrical surface may be substituted for the pipe wrench flats illustrated in the tool 10 on the exterior sides of the stud 22 and the barrel member 14. Also, the convex, outwardly facing surfaces of the wedge members may be provided with knurling or radially outwardly projecting teeth in order to enhance the frictional grip on a plumbing part to be installed or removed. Accordingly, the scope of the invention should not be construed as limited to the specific embodiment depicted and described, but rather is defined in the claims appended hereto.

What is claimed is:

1. A plumbing tool comprising:

an elongated solid core element having a stud end, an intermediate cylindrical section bearing external right-hand threads, and an outwardly flared opposite end that increases in diameter with distance from said intermediate threaded cylindrical section, a hollow, annular barrel element that is shorter than said core member and which has an interior surface, one end of which has internal right-hand threads defined thereon and another end of which has a radially inwardly directed lip defined thereon, and an annular radially inwardly facing groove is defined in said interior barrel surface between said internal threads and said lip, and a plurality of wedge elements each having a proximal end with a radially outwardly projecting tang formed thereon and a distal end having an arcuate, concave, radially inwardly facing surface, and said wedge elements are disposed about said core element in angular displacement from each other with all of their tangs engaged in said groove and captured between said barrel element and said core element by said annular lip so that said wedge elements are restrained from longitudinal movement relative to send barrel element, and whereby said distal ends of said wedge elements are coupled to said lip for limited radial rotational movement relative thereto.

2. A plumbing tool according to claim 1 wherein said distal ends of each of said wedge elements have convex outwardly facing arcuate surfaces and each of said wedge elements has an arcuate cross-sectional configuration.

3. A plumbing tool according to claim 2 wherein each of said wedge elements has an arcuate groove defined in its outwardly facing surface to receive said lip therein at its proximal end.

4. A plumbing tool according to claim 1 wherein said stud end of said core element has gripping tool engagement flats defined thereon and said barrel element has an exterior surface with gripping tool flats defined thereon.

5. A plumbing tool according to claim 4 wherein said barrel element has an exterior surface and six gripping tool flats of equal dimensions are defined about the circumference of said exterior surface of said barrel element.

6. A plumbing tool according to claim 1 wherein the radial thickness of said distal ends of said wedge elements decreases with increasing distance from said proximal ends.

7. A plumbing tool according to claim 1 comprising a total of three of said wedge elements as aforesaid.

8. A plumbing tool according to claim 1 wherein said outwardly flared opposite end of said core element has a frustoconical shape.

9. A plumbing tool comprising:

a solid core member formed with a part-engaging end section, a cylindrical intermediate section with external right-hand threads defined thereon, and a stud section having a maximum cross-sectional dimension no greater than the diameter of said cylindrical section and wherein the diameter of said part-engaging section increases from said intermediate section with distance from said stud section, a hollow barrel member shorter then said core member and having a core-engaging end with a radial inner surface having internal right-hand threads defined thereon, wherein said core-engaging end is threadably engaged with said threaded section of said core, and an opposite wedge-engaging end with a radial inner surface having a radially inwardly projecting annular lip at its extremity and a channel formed in said radial inner surface of said wedge-engaging end located between said lip and said core-engaging end, and a plurality of elongated wedge members disposed in angular displacement from each other about said core member and each of said wedge members has a hooked proximal end that extends radially outwardly and is captured in said channel by said lip between said core member and said barrel member and a distal end.

10. A plumbing tool according to claim 9 wherein said distal end of said wedge member has an arcuate, concave radially inwardly facing surface and is tapered in thickness so that the thickness of said distal end decreases with distance from said proximal end.

11. A plumbing tool according to claim 9 wherein said barrel member has an exterior surface with gripping tool engaging flats defined thereon.

12. A plumbing tool according to claim 9 wherein each of said wedge members has the neck formed at said proximal end and an outer convex surface with a radially outwardly facing groove defined at said neck to receive said lip of said barrel member.

13. A plumbing tool according to claim 9 wherein said part-engaging end section of said core member has a frustoconical shape.

14. A plumbing tool comprising:

an elongated core member formed with an externally threaded cylindrical section having opposing ends and right-hand threads defined thereon, a longitudinally projecting gripping stud at one of said ends of said cylindrical section, and a longitudinally projecting frustoconical section at said other of said ends of said cylindrical section, wherein the diameter of said frustoconical section increases with distance from said cylindrical section, a barrel member shorter then said core member and having an external surface for engagement by a gripping tool and having one end with internal right-hand threads defined thereon that are engaged with said external right-hand threads of said cylindrical section of said core member and another end with a radially interior wall surface defining a radially inwardly projecting annular lip at its extremity and a radial channel located between said lip and said internal right-hand threads, and a plurality of elongated wedge members each having an arcuate cross section and each having a proximal end with a radially outwardly projecting hook thereon and a tapered distal end that decreases in thickness with distance from said proximal end and which has a concave surface facing said elongated core member, and said wedge members are disposed about said core member in angular displacement from each other with said hooks of said wedge members all projecting into said channel so that said proximal ends of said wedge members are all captured by said annular lip between said barrel member and said core member and are restrained from longitudinal movement relative to said barrel member by said lip while said distal ends of said wedge members extend longitudinally beyond said barrel member and alongside said frustoconical section of said core member.

15. A tool according to claim 14 further comprising three of said wedge members as aforesaid.

16. A tool according to claim 15 wherein each of said wedge members is formed with a neck of reduced thickness at said proximal end and said neck has an outwardly facing depression and said lip projects radially inwardly into said outwardly facing depressions at said necks of all of said wedge members.

* * * * *